United States Patent [19]

Bailey et al.

[11] 4,056,754

[45] Nov. 1, 1977

[54] VIDICON HAVING SWITCHABLE ELECTRODE CONNECTIONS

[75] Inventors: Philip Charles Bailey, Writtle; Hans Scholz, Maldon, both of England

[73] Assignee: Electric Valve Company Limited, England

[21] Appl. No.: 661,131

[22] Filed: Feb. 25, 1976

[30] Foreign Application Priority Data

Mar. 1, 1975 United Kingdom ..... 8656/75

[51] Int. Cl.[2] ..... H01J 31/38; H01J 29/46

[52] U.S. Cl. ..... 313/390; 313/318

[58] Field of Search ..... 313/384, 390, 389, 388

[56] References Cited

U.S. PATENT DOCUMENTS

| | | | |
|---|---|---|---|
| 3,260,888 | 7/1966 | Webb | 313/318 |
| 3,864,585 | 2/1975 | Scholz | 313/390 |

OTHER PUBLICATIONS

Olympic Chassis KU; Howard W. Sams & Co. Inc.; Photofact Folder Set 550, Folder 1; Oct. 1961.

*Primary Examiner*—Robert Segal

*Attorney, Agent, or Firm*—Diller, Brown, Ramik & Wight

[57] ABSTRACT

A separate mesh vidicon in which in order to reduce voltage pick-up from the scanning field by the conductor system which makes connection to the mesh and at the same time provide a tube which is relatively insensitive to rotation about its axis when positioned within its scanning yoke, connection to the mesh is made within the area occupied in operation, by the scanning field, by a cylindrical conductor surrounding the usually provided cylindrical anode, the remainder of the connection path being provided by a number of conductors arranged symmetrically about the axis of the tube, and an external removable link is provided bridging between the mesh terminal pin and the anode terminal so that the tube may be operated at will as a separate or integral mesh tube.

2 Claims, 4 Drawing Figures

VIDICON HAVING SWITCHABLE ELECTRODE CONNECTIONS

Figure 1:
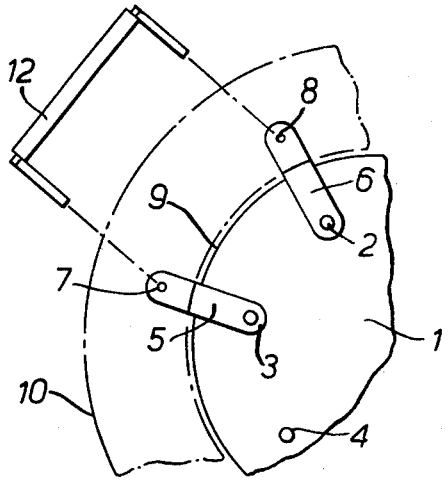

This invention relates to the invention which is the subject of our U.S. Pat. No. 3,864,585.

This invention, like our earlier invention, relates to camera tubes and more specifically to vidicon tubes. Vidicon tubes may be classified into two types in dependence upon the arrangement of their field terminating mesh. The first type is the so-called integral mesh type in which a field mesh positioned before the target is carried by a cylindrical end portion of the anode electrode so as to run at a common potential therewith. The second type is the so-called separate mesh type in which there is provided a field mesh arranged between a target and an anode having a cylindrical portion, which mesh is separated from both said target and said anode, connection being made to said mesh from a point outside the envelope of the tube by electrical connection means extending along the interior length of the envelope. Each type of construction has its advantages for difficult applications.

Our earlier invention referred to above relates to vidicon tubes of the last-mentioned type i.e. the separate mesh type.

As is pointed out in the specification of U.S. Pat. No. 3,864,585 if the electrical connection means to the field mesh of a vidicon of the separate mesh type consists of a single conductor false video signals are liable to appear in the tube output caused, it is beleived, by voltage pick-up by the field mesh conductor from the scanning fields of the tube. To overcome this difficulty it is known to provide a plurality of current paths from the base of the tube to the field mesh, which paths are symmetrically distributed around the axis of the tube. Commonly two conductors are employed arranged in diametrically opposite fashion, The object of using a plurality of current paths is to achieve what may be termed mutually balancing pickup, the undesirable effects of pick-up from the scanning fields on one current path being cancelled out or approximately so by opposing effects by another, diametrically opposed, current path.

Whilst such multiple path tubes can be made with satisfactory immunity to the effects of voltage pick-up from the scanning fields of the tube, they are sensitive as regards or orientation within the scanning coil yoke. This is a very serious defect indeed where such tubes are used in multiples in a colour camera, since it is quite commonly required to rotate the tubes about their longitudinal axis in order to optimise such parameters as geometry.

Our earlier invention sought to provide an improved vidicon of the kind referred to, which, whilst providing a satisfactory degree of immunity from the effects of voltage pick-up by the connection means to the field mesh, at the same time was relatively insensitive to its orientation within the scanning yoke.

According to our earlier invention, a vidicon tube is provided including within an envelope, a target, a target electrode in electrical contact with the target, an anode of which the portion nearast the target is cylindrical, a field mesh electrically isolated from and positioned closely adjacent the target electrode between the target electrode and the cylindrical portion of the anode, terminal means passing through the envelope, and electrical connection means electrically connecting the terminal means to the field mesh; wherein, the electrical connection means includes a conductive cylindrical member coaxial with and surrounding the anode and extending at least approximately to the end of the cylindrical portion of the anode, the opposite end portions of the cylindrical member using electrically connected, respectively, to the perimeter of the field mesh and to a plurality of electrical conductors which are disposed symmetrically about the axis of the tube an extend to the terminal means.

According to this invention a vidicon tube includes within an envelope, a target, a target electrode in electrical contact with the target, an anode of which the portion nearest the target is cylindrical, a field mesh electrically isolated from and positioned closely adjacent the target electrode between the target electrode and the cylindrical portion of the anode, terminal means passing through the envelope, and electrical connection means electrically connecting the terminal means to the field mesh; wherein, the electrical connection means includes a conductive cylindrical member coaxial with and surrounding the anode and extending at least approximately to the end of the cylindrical portion of the anode, the opposite end portions of the cylindrical member being electrically connected, respectively, to the perimeter of the field mesh and to a plurality of electrical conductors which are disposed symmetrically about the axis of the tube and extend to the terminal means, and wherein means are provided outside of the tube envelope, for making and breaking an electrical connection between a terminal to which said mesh is connected and a terminal to which said anode is connected whereby said tube is operative at will as an integral mesh or a separate mesh tube.

With a tube in accordance with the present invention it will be found that both when operated as a separate mesh tube and when operated as an integral mesh tube, the tube provides a satisfactory degree of immunity from the effects of voltage pick-up by the connection means to the field mesh, whilst at the same time being relatively insensitive to its orientation within a scanning yoke.

Preferably said making and breaking means comprises removable link means between two conductive members connected one to one of said terminals and the other to the other.

Preferably said link means comprises a short circuiting bridge member which is pluggable into sockets provided in said conductive members and, where said terminals are adjacent ones of a ring of terminals extending through the base of the tube, each of said conductive members comprises a tag extending substantially radially outwardly from the terminal to which it is attached and bearing its socket outwardly of the periphery of the base of the tube and in a position covered by the normally provided base cap of the tube, access to said sockets for said pluggable bridge member being provided for by holes provided in said cap.

Preferably again each socket is a printed circuit board socket of the kind having a serrated outer surface by means of which it is secured in the material of said base cap.

Figure 2:
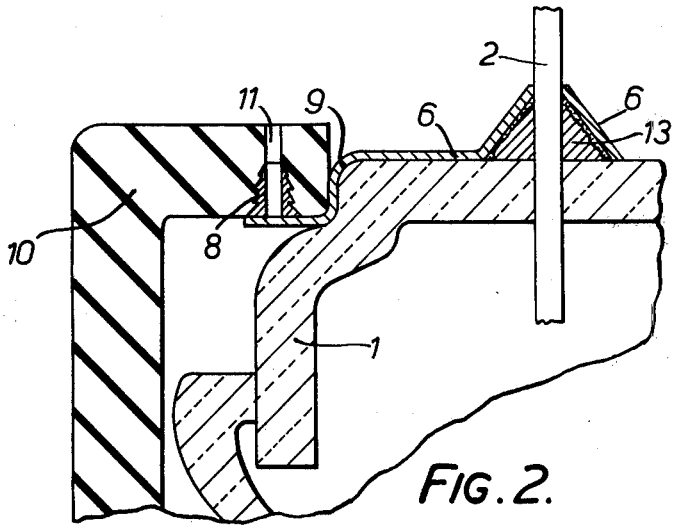
Figure 3:
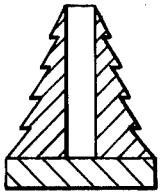

The invention is illustrated in and further described with reference to the accompanying drawing in which, FIG. 1 is a part cut away plan view of the base of one vidicon tube in accordance with the present invention, FIG. 2 is a part cut away section of the tube of FIG. 1 showing the detailed arrangement for one of the terminals, FIG. 3 is a section of one of the sockets 7 or 8 used in the tube of FIGS. 1 and 2, and Figure A is an elevational view of the vidicon tube.

Referring to the drawing, the glass base of the vidicon tube is represented at 1. Extending through the base is a ring of terminals 2, 3, 4 of which 2 and 3 are connected internally to the field mesh and anode electrode of the tube.

Figure 4:
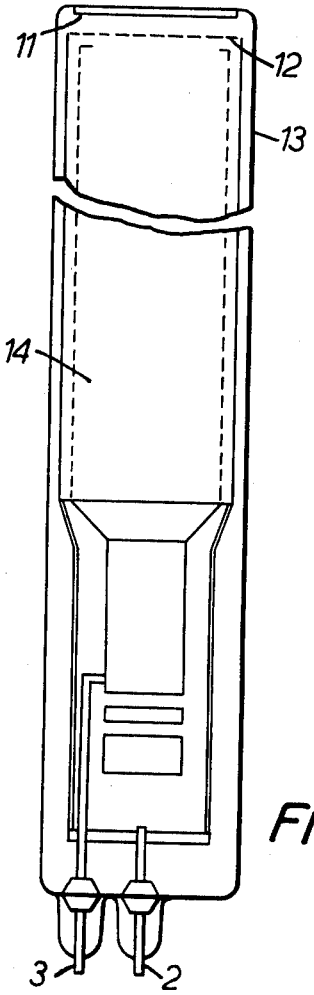

Referring to FIG. 4, the target electrode of the vidicon camera tube shown therein is referenced 11, the separate field mesh electrode is referenced 12, the envelope of the tube is referenced 13, the tubular anode electrode, G3 as it is often called, is referenced 14. The terminals 2 and 3 are shown connected as previously described.

Connected to each of the terminals 2 and 3 are tags referenced 5 and 6 respectively. Each tag 5 or 6 extends radially outward beyond the periphery 9 of the base of the tube and carries, in a position covered by the normally provided base cap 10 of the tube, a printed circuit board socket referenced 7 and 8 respectively. The periphery of the base cap 10 is shown in dotted outline in FIG. 1.

As most clearly seen from FIG. 3 the outer surface of the printed circuit board socket 7 or 8 is serrated. Each socket is pushed into a hole 11 extending throuh the end cap 10. The serrated outer surface of each socket secures this in the material of the end cap 10. It will be seen that the tag member 6 is shaped to fit closely over the glass base fillet 13 sealing the terminal 2 to the base 1. Tag member 7 is similarly shaped. The connection of the connectors 7 and 8 to the tags 5 and 6, and the connection of the tags 5 and 6 to the pins 2 and 3 is by solder.

A pluggable bridge member 12 is provided to plug into the two sockets 7 and 8 and so electrically connect the anode and field mesh electrodes together when it is desired to operate the tube as an integral mesh tube.

We claim:

1. A vidicon tube including within an envelope, a target, a target electrode in electrical contact with the target, an anode of which the portion nearest the target cylindrical, a field mesh electrically isolated from and positioned closely adjacent the target electrode between the target electrode and the cylindrical postion of the anode, terminal means passing through the envelope, and electrical connection means electrically connecting the terminal means to the field mesh; wherein, the electrical connection means includes a conductive cylindrical member coaxial with and surrounding the anode and extending at least approximately to the end of the cylindrical portion of the anode, the opposite end portions of the cylindrical member being electrically connected, respectively, to the perimeter of the field mesh and to a plurality of electrical conductors which are disposed symmetrically about the axis of the tube and extend to the terminal means, and wherein means are provided, outside of the tube envelope, for making and breaking an electrical connection between the terminal to which said mesh is connected and a terminal to which said anode is connected whereby said tube is operative as an integral mesh or a separate mesh tube, said means for making and breaking comprising removable link means between two conductive members connected one to one of said terminals and the other to the other of said terminals, and said link means comprising a short circuiting bridge which is pluggable into sockets provided in said conductive members and, said terminals being adjacent ones of a ring of terminals extending through the base of the tube, each of said conductive members comprising a tag extending substantially radially outwardly from the terminal to which it is attached and bearing its socket outwardly of the periphery of the base of the tube and in a position covered by the normally provided base cap of the tube, access to said sockets for said pluggable bridge member being provided for by holes provided in said cap.

2. A tube as claimed in claim 1 and wherein each socket is a printed circuit board of the kind having a serrated outer surface by means of which it is secured in the material of said base cap.

* * * * *